US005292380A

United States Patent [19]

Tanigawa et al.

[11] Patent Number: 5,292,380

[45] Date of Patent: Mar. 8, 1994

[54] PERMANENT MAGNET FOR ACCELERATING CORPUSCULAR BEAM

[75] Inventors: Shigeho Tanigawa, Konosu; Kimio Uchida, Kumagaya, both of Japan

[73] Assignee: Hitachi Metals, Ltd., Tokyo, Japan

[21] Appl. No.: 242,947

[22] Filed: Sep. 9, 1988

[30] Foreign Application Priority Data

Sep. 11, 1987 [JP] Japan ..... 62-228883

[51] Int. Cl.[5] ..... H01F 1/053

[52] U.S. Cl. ..... 148/302; 420/83

[58] Field of Search ..... 252/62.55; 148/302; 420/83, 440

[56] References Cited

U.S. PATENT DOCUMENTS

| | | | |
|---|---|---|---|
| 4,225,339 | 9/1980 | Inomata et al. | 148/403 |
| 4,402,770 | 9/1983 | Koon | 420/435 |
| 4,601,875 | 7/1986 | Yamamoto et al. | 419/23 |
| 4,827,235 | 5/1989 | Inomata et al. | 148/302 |
| 4,859,254 | 8/1989 | Mizoguchi et al. | 148/302 |
| 4,935,075 | 6/1990 | Mizoguchi et al. | 148/302 |

FOREIGN PATENT DOCUMENTS

| | | |
|---|---|---|
| 0101552 | 2/1984 | European Pat. Off. . |
| 0106948 | 5/1984 | European Pat. Off. . |
| 0133758 | 6/1985 | European Pat. Off. . |
| 0174735 | 3/1986 | European Pat. Off. . |
| 0216254 | 4/1987 | European Pat. Off. . |
| 0248981 | 12/1987 | European Pat. Off. . |
| 0258609 | 3/1988 | European Pat. Off. . |
| 59-46008 | 3/1984 | Japan . |
| 60-221549 | 4/1984 | Japan . |
| 60-238447 | 5/1984 | Japan . |
| 60-243247 | 5/1984 | Japan . |
| 61-210862 | 9/1986 | Japan . |
| 61-266056 | 11/1986 | Japan . |
| 61-243153 | 3/1987 | Japan . |

OTHER PUBLICATIONS

Hadjipanayis et al., "Cobalt-Free Permanent Magnet Materials Based on Iron-rare-earth Alloys", *J. of Applied Physics*, 55(6), 15 Mar. 1984, pp. 2073-2077.

Tsutai et al., "Effect of Ga Addition to NdFeCoB on their Magnetic Properties", Appl. Phys. Lett. 51 (1987) 28 Sep. No. 13 pp. 1043-1045.

W. Ervens, "Vergleich der Eigenschaften von Neodym-Eisen-Bor-und Samarium-Cobalt-Dauermagneten", 29A Technische Mitteilungen Krupp. Forschungsberichte 43 (1985) Dez., No. 3, pp. 63-66.

Mizoguchi et al., "Nd-Fe-B-Co-Al Based Permanent Magnets with Improved Magnetic Properties and Temperature Characteristics", Appl. Phys. Lett. 48(19), May 12, 1986, pp. 1309-1310.

Sagawa, Patent Abstracts of Japan, Jun. 22, 1984.

Hirozawa, Patent Abstracts of Japan, Mar. 19, 1987.

Gudimetta et al., "Magnetic Properties of Fe-R-B Powders", Appl. Phys. Lett. 48 (10), Mar. 10, 1986, pp. 670-672.

Sagawa et al., New Material for Permanent Magnets on a Base of Nd and Fe (Invited), J. Appl. Phys. 55(6) Mar. 15, 1984, pp. 2083-2087.

*Primary Examiner*—George Wyszomierski

*Attorney, Agent, or Firm*—Finnegan, Henderson, Farabow, Garrett & Dunner

[57] ABSTRACT

A permanent magnet having superior resistance to radioactive deterioration of magnetic properties. The magnet has a composition represented by the formula $R_aFe_{bal.}Co_bB_cGa_dM_e$, in which the R denotes at least one element selected from the group consisting of Nd, Pr, Dy, Tb, Ho, and Ce, and the M denotes at least one element selected from the group consisting of Al, Si, Nb, Ta, Ti, Zr, Hf, and W, with the proviso that $12 \leqq a \leqq 18$, $0 \leqq b \leqq 30$, $4 \leqq c \leqq 10$, $0.01 \leqq d \leqq 3$ and $0 \leqq e \leqq 2$ in terms of atomic percent. The permanent magnet has fine crystal grains provided with magnetic anisotropy.

3 Claims, 2 Drawing Sheets

PERMANENT MAGNET FOR ACCELERATING CORPUSCULAR BEAM

BACKGROUND OF THE INVENTION

The present invention relates to a permanent magnet for an accelerating corpuscular beam used in a wiggler, undulator, traveling-wave tube, magnetron, cyclotron, etc., and is particularly characterized by a magnet of fine-grain type which is able to resist damage caused by radioactive rays.

A permanent magnet for accelerating a corpuscular beam is required to generate a strong magnetic field in a space (space magnetic field) and to resist damage caused by any radioactive rays generated or leaked.

R-Co type magnets composed of a rare earth element (referred to as "R" hereinafter) and cobalt have generally been used as permanent magnets capable of generating strong space magnetic fields. However, the strength of the space magnetic field generated by such a permanent magnet depends upon the quality of the magnetic circuit design, and is only about 2000 gauss.

For this reason Nd-Fe-B type magnets which generate stronger space magnetic fields than with a conventional R-Co type magnet have appeared (refer to Japanese Patent Laid-Open No. 46008/1984).

This has allowed development of a permanent magnet for use in undulator apparatus and apparatus for converging high-speed charged corpuscular beams by utilizing a Nd-Fe-B type magnet (Japanese Patent Laid-Open No. 243153/1986).

It may be considered that it is desirable to use such a Nd-Fe-B type magnet because it generates a strong space magnetic field and has resistance to damage caused by radioactive rays owing to the fact that only a small amount of Co is contained therein.

Undulator apparatus generate very high-frequency X rays with a wave length of 1 to 100Å when an electron beam is accelerated and deflected by a series of permanent magnets and is used in lithographic apparatus for semiconductors. Wigglers are basically similar to such undulators but differ from them in that they generate a beam with a wavelength as short as 1 to 0.01Å. The wiggler is an apparatus which generates free electron laser.

Conventional Nd-Fe-B magnets include sintered magnets produced by a powder metallurgy method and so-called nucleation-type permanent magnets (European Patent Laid-Open Publication No. 0101552). Such types of permanent magnet manifest their magnetism by virtue of a rich Nd phase surrounding a principal phase represented by $Nd_2Fe_{14}B$, and they attain sufficient coercive force only when the grains for constituting the magnet are ground to a size near the critical radius of a single magnetic domain (about 0.3 μm). It is thought to be ideal for the principal phases to be separated from each other by R-rich non-magnetic phases containing large amounts of R.

However, it has been found from experience that, when an accelerator for a corpuscular beam is formed by using a nucleation-type permanent magnet, there is a limit to the wave length of the corpuscular beam that can be accelerated by this accelerator which limit is at most approximately equivalent to the wave length of the rays generated by an undulator apparatus. Thus, accelerator cannot be used to accelerate very high-frequency and high-energy rays generated by a wiggler.

In other words, if a permanent magnet is of the nucleation type and if the composition thereof is changed, the permanent magnet is fundamentally incapable of avoiding radiation damage, which consequently limits its use as an accelerator for a corpuscular beam.

Accordingly, the inventors conceived a pinning type, the Nd-Fe-B type permanent magnet which is different from the conventional Nd-Fe-B type magnet. The inventors found that the addition of Ga had the effect of providing the magnet with resistance to radiation damage while improving coercive force, which led to the solution of the problems associated with conventional magnets.

In the pinning type magnet the movements of magnetic domain walls are pinned by precipitates and a coercive force generation mechanism is completely distinguished from that of the above-described nucleation-type magnet.

The present invention provides a permanent magnet for accelerating a corpuscular beam which is represented by the composition formula $R_aFe_{bal.}Co_bB_cGa_{dMe}$ in which the R denotes at least one element selected from the group consisting of Nd, Pr, Dy, Tb, Ho and Ce, the M denotes at least one element selected from the group consisting of Al, Si, Nb, Ta, Ti, Zr, Hf and W, with the proviso that $12 \leqq a \leqq 18$, $0 \leqq b \leqq 30$, $4 \leqq c \leqq 10$, $0.01 \leqq d \leqq 3$ and $0 \leqq e \leqq 2$ in terms of atomic %, the permanent magnet having fine crystal grains provided with magnetic anisotropy.

In the present invention, very fine crystal grains having grain sizes of 0.01 to 0.5 μm, which are very much smaller than the 0.3 to 80 μm dimension of the grains obtained by a conventional powder metallurgy method, can be obtained from an alloy melt having the above compositional formula by a rapid quenching method. The flakes and powder obtained by the rapid quenching method are consolidated by means of a hot press and the like and then subjected to plastic deformation so as to provide magnetic anisotropy.

Although the aforementioned technical idea was previously disclosed in European Patent Laid-Open Publication No. 0133758, the inventors have ascertained optimum working conditions as well as finding that the the use of Ga as an additional element has the effect of improving or minimizing the in the coercive force which reduction occurs as the result of heating and plastic deformation and also improving the resistance to radiation damage.

In the present invention, the ratio of plastic working $h_0/h$ is defined by the ratio of the height $h_0$ of a specimen before plastic working (for example, upsetting) to the height h of the specimen after plastic working (for example, upsetting), and it is preferable in cases of obtaining Br of 11 kG or more that the ratio of $h_0/h$ is 2 or more. Br is set at 11 kG or more because this value cannot be achieved by a sintering method using a longitudinal magnetic press and can be achieved for the first time by the present invention.

The reasons for limiting the composition of the present invention are as follows:

If R is less than 12 at%, α-Fe appears, preventing provision of sufficient iHc, while if R exceeds 18 at%, the value of Br is reduced.

Since Nd and Pr among the elements representing R exhibit high degrees of saturation magnetization, the condition $(Pr+Nd)/R \geqq 0.7$ must be satisfied in order to attain the requirement of Br being 11 kG or more.

Ce is contained in an inexpensive material such as didymium. If the amount of Ce added is small ($Ce/R \leqq 0.1$), the magnetic characteristics of the resultant magnet are not adversely affected.

Dy, Tb and Ho serve to effectively improve the coercive force. However, $(Tb+Dy)/R \leqq 0.3$ must be satisfied in order to achieve the condition of Br being 11 kG or more.

Co replaces Fe to increase the Curie point of the magnetic phase. Addition of Co together with Ga improves both the temperature coefficient of Br and the irreversible demagnetizing factor at high temperatures.

If the amount of B is less than 4 at %, the $R_2Fe_{14}B$ phase is not sufficiently formed as a principal phase, while if the amount exceeds 11 at %, the value of Br is reduced due to the occurrence of phases that are undesirable with respect to the magnetic characteristics.

Ga has a significant effect in terms of improving the coercive force and resistance to radiation damage. However, if the amount of Ga is less than 0.01 at%, there is no effect. If the amount exceeds 3 at %, the coercive force is, on the contrary, reduced.

The elements in the compositional formula denoted by M serve to effectively improve the coercive force. Of the elements denoted by M, Zn, Al and Si are capable of improving the coercive force, and the reduction in the value of Br will be small when the amount of these elements added is not more than 2 at%. Although Nb, Ta, Ti, Zr, Hf and W are capable of suppressing the growth of crystal grains and improving the coercive force, they impair workability with the result that they are preferably added in an amount of no more than 2 at %, more preferably 1 at% or less.

The most desirable type of plastic working employed in the present invention is warm upsetting in which so-called near net shaping can be performed by using a mold having the final shape. However, extrusion, rolling and other types of working can also be employed.

It is also effective to perform the above-described plastic working subsequent to consolidation by using a hot press before the temperature decreases. Although heating may also be performed after the plastic working, when a composition in which a particularly remarkable effect of addition of Ga occurs is selected, the effect obtained without conducting any heating is equal to that obtained by heating.

A green compact has very great deformation resistance when the deformation temperature is lower than 600° C. and thus is not easily subjected to working, and the Br value of the resultant magnet is low. On the other hand, if the deformation temperature is over 800° C., the coercive force is reduced to a value less than 12 kOe due to the growth of crystal grains.

If the strain rate is $1\times10^{-4}\,sec^{-1}$ or less, the coercive force is reduced due to the long period of the working time, and the production efficiency is thus low. Such a strain rate is therefore undesirable. On the other hand, if the strain rate is $1\times10^{-1}\,sec^{-1}$ or more, this is too high a rate to allow sufficient plastic flow to be obtained during working, with the result that anisotropy cannot be sufficiently provided, and cracks easily occur.

Lastly, an explanation will be given of the application of the present invention.

The permanent magnet of the present invention is not limited to wiggler and undulator apparatus and can be widely used as a permanent magnet for accelerating a corpuscular beam for a traveling wave tube mounted on a satellite, a magnetron, a cyclotron or a quadrupole magnet. Such quadrupole magnets are also called Quads and are used for generating strong magnetic fields.

DETAILED DESCRIPTION OF PREFERRED EMBODIMENTS

The present invention is described below with reference to examples, but the present invention is not limited to the forms of these examples and can be widely used as described above.

EXAMPLES

The present invention is described in detail below with reference to examples.

EXAMPLE 1

An alloy having the composition of $Nd_{14}Fe_{79.5}B_6Ga_{0.5}$ was formed into an ingot as a mother alloy by arc melting. The thus-formed mother alloy was again melted by high-frequency heating in an atmosphere of Ar and then quenched on a single roll to form flake-shaped specimens. The flakes obtained with the peripheral speed of the roll at 30 m/sec had various forms having thicknesses of $25\pm3$ μm. It was found from the results of X-ray analyses that each of the thus-obtained flakes was composed of a mixture of an amorphous phase and a crystal phase. Each of the flakes was roughly ground into fine grains of 32 mesh or less which were then subjected to cold molding in a mold at a molding pressure of 3.0 ton/cm$^2$ to form a green compact. This green compact was then heated by a high-frequency heater, was densified in a metal mold by applying pressure of 1.5 ton/cm$^2$ thereto and was then subjected to upsetting at 750° C. The strain rate during upsetting was $2.5\times10^{-2}\,sec^{-1}$. After upsetting, a sample measuring $5\times5\times7$ mm$^t$ was cut off from the obtained material so as to be used in experiments.

Figure 1A:
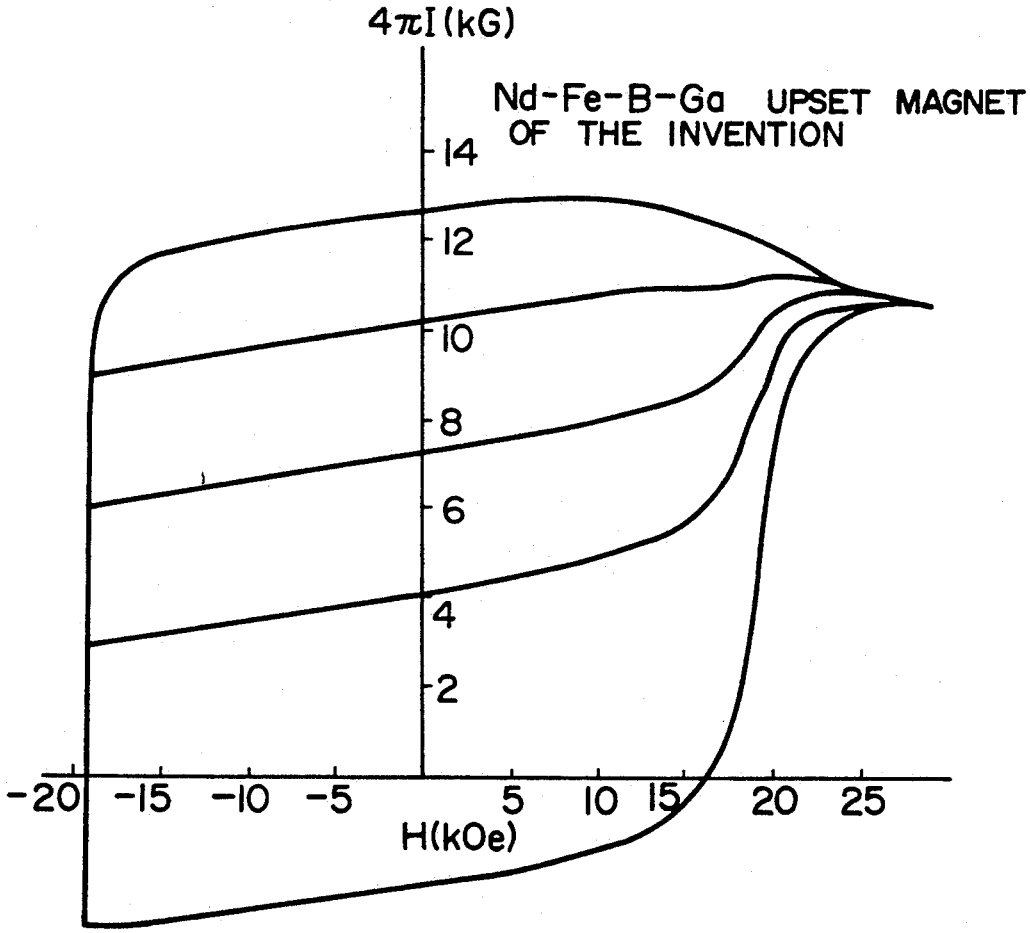
FIG. 1A shows recoil curves of a magnet alloy of the present invention.
Figure 1B:
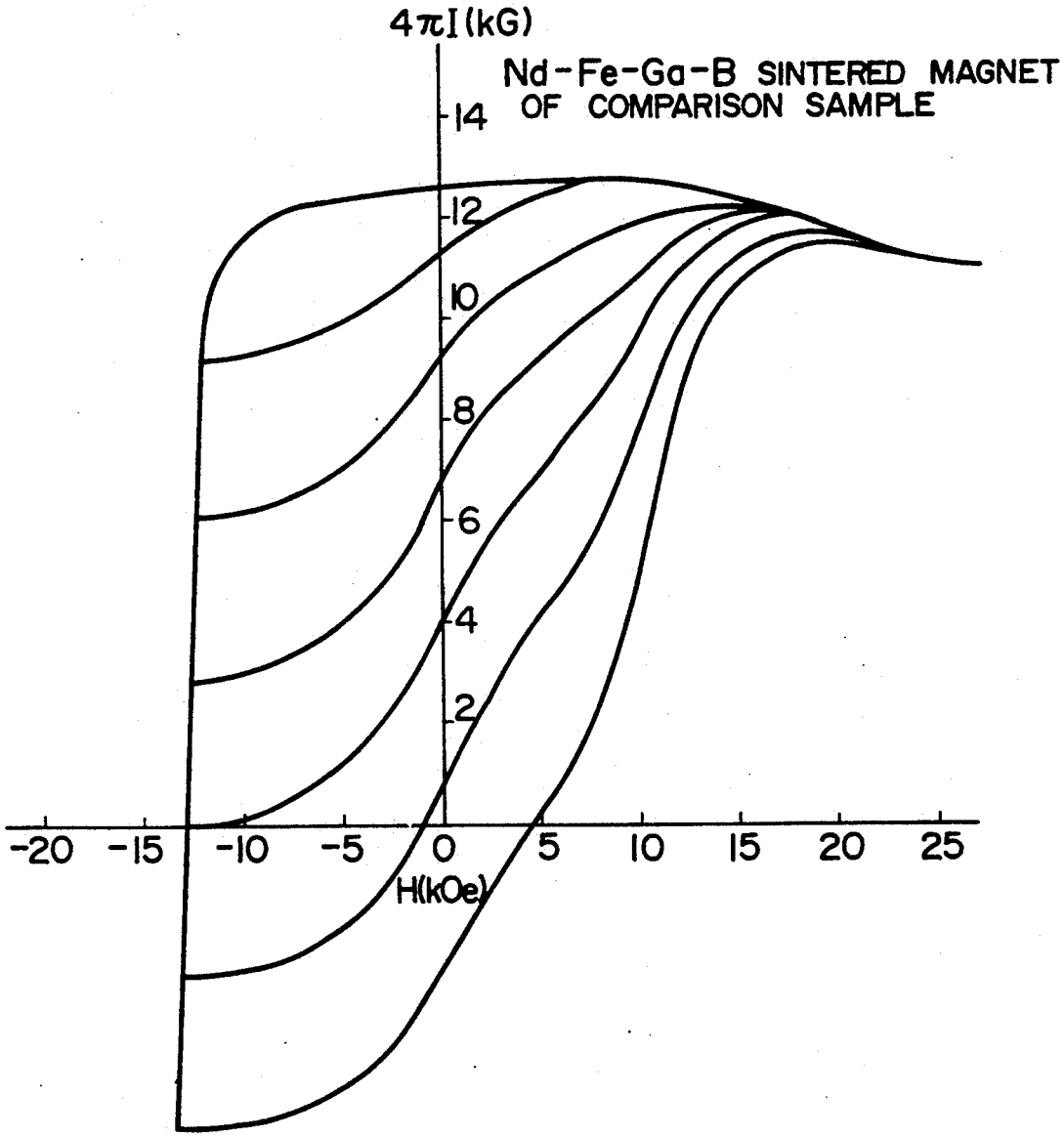
FIG. 1B shows recoil curves of a comparison example.

In order to obtain comparison samples, alloys respectively having the compositions $Nd_{14}Fe_{79.5}B_6Ga_{0.5}$ and $Nd_{15.5}Fe_{78}B_6Ga_{0.5}$ were formed into ingots by arc melting. Each of the thus-obtained ingots was finely ground into grains with an average grain size of 4 μm or less, was formed in a magnetic field and was sintered for 1 hour at 1080° C. in vacuum. After the thus-obtained sintered compacts had been subjected to heating treatment for 1 hour at 600° C. in an atmosphere of Ar, samples each measuring $5\times5\times7$ mm$^t$ were cut off from the sintered compacts to thereby obtain comparative samples. Table 1 and FIG. 1 respectively show comparison of the sample of the Example 1 with the comparison examples with respect to the magnetic characteristics obtained by measurements using a B-H tracer and with respect to the recoil curves.

TABLE 1

| | Composition | Br (kG) | iHc (kOe) | (BH)m (MGOe) |
|---|---|---|---|---|
| The present invention | $Nd_{14}Fe_{79.5}B_6Ga_{0.5}$ (quenched-upset magnet) | 12.5 | 19.0 | 36.4 |
| Comparison Sample 1 | $Nd_{14}Fe_{79.5}B_6Ga_{0.5}$ (sintered magnet) | 3.5 | 0.2 | 0 |
| Comparison | $Nd_{15.5}Fe_{78}B_6Ga_{0.5}$ | 12.6 | 13.0 | 37.2 |

TABLE 1-continued

| | Composition | Br (kG) | iHc (kOe) | (BH)m (MGOe) |
|---|---|---|---|---|
| Sample 2 | (sintered mganet) | | | |

As shown in Table 1, the present invention enables a high degree of coercive force to be obtained, as compared with the sintered magnets. It is also seen that the sintered magnet of Comparative Example 1 which has the same composition as that of the upset magnet of the present invention fails to exhibit properties necessary for a permanent magnet because the Nd-rich grain boundary phases necessary for generating coercive force are not formed in the sintered magnet. It is also found from the recoil curves shown in FIGS. 1A and 1B that the upset magnet of the present invention has a mechanism of generating coercive force which is a pinning type mechanism and is different from that of the sintered magnet of Comparative Sample 2.

EXAMPLE 2

Each of the sample formed in Example 1 and the comparison sample 2 formed therein were continuously irradiated with $\gamma$ rays, and the magnetic characteristics thereof were measured after 100 hours, 500 hours, 1000 hours and 5000 hours had elapsed.

In order to eliminate any of the effects of thermal changes, the experiments were done while keeping the samples in liquid nitrogen.

The results are shown in Table 2.

TABLE 2

| | | | Irradiation time | | | |
|---|---|---|---|---|---|---|
| | | | 100 H | 500 H | 1,000 H | 5,000 H |
| Instant Invention | $Nd_{14}Fe_{79.5}B_6Ga_{0.5}$ (upset magnet) | Br (kG) | 12.5 | 12.5 | 12.5 | 12.5 |
| | | iHc (kOe) | 19.0 | 19.0 | 19.0 | 19.0 |
| Comparison Sample | $Nd_{15.5}Fe_{78}B_6Ga_{0.5}$ (sintered magnet) | Br (kG) | 12.6 | 1.26 | 12.4 | 12.0 |
| | | iHc (kOe) | 12.8 | 11.5 | 10.0 | 9.0 |

As seen from Table 2, the quenched-and-upset magnet of the present invention exhibits no deterioration in the magnetic characteristics thereof by irradiation of $\gamma$ rays.

EXAMPLE 3

Both the sample obtained in Example 1 and the comparison sample 2 formed therein were irradiated with neutron rays of 15 MeV continuously for 200 hours, and the magnetic characteristics thereof were measured after the irradiation. The results are shown in Table 3.

TABLE 3

| | | Br (kG) | iHc (kOe) | (BH)m (MGOe) |
|---|---|---|---|---|
| The instant invention | After irradiation | 12.5 | 19.0 | 36.4 |
| | Before irradiation | 12.5 | 19.0 | 36.4 |
| Comparison Sample | After irradiation | 12.6 | 9.5 | 37.0 |
| | Before irradiation | 12.6 | 13.0 | 37.2 |

As seen from Table 3, the quenched-and-upset magnet of the present invention exhibits no reduction in the coercive force by the irradiation of neutron rays.

What is claimed is:

1. A permanent magnet having superior resistance to radioactive deterioration of magnetic properties when subjected to a corpuscular beam having a wave length of not more than about 1Å, said magnet having a composition consisting essentially of $R_aFe_{bal.}Co_bB_cGa_dM_e$ where R is at least one element selected from the group consisting of Nd, Pr, Dy, Tb, Ho, and Ce, and M is at least one element selected from the group consisting of Al, Si, Nb, Ta, Ti, Zr, Hf, and W, with the proviso that $12 \leqq a \leqq 18$, $0 \leqq b \leqq 30$, $4 \leqq c \leqq 10$, $0.01 \leqq d \leqq 3$, and $0 \leqq e \leqq 2$ in terms of atomic percent, said magnet having a microstructure comprised of fine crystal grains having an average grain size of about 0.01 μm to about 0.5 μm and being magnetically anisotropic, said crystal grains being rendered magnetically anisotropic by plastically deforming said magnet at a temperature in the range from about 600° C. to about 800° C. at a strain rate in the range from about $1\times10^{-4}$ $sec^{-1}$ to about $1\times10^{-1}$ $sec^{-1}$, the plastic working ratio $h_o/h$, where $h_o$ is the height of said magnet before plastic deformation and h is the height of said magnet after plastic deformation, being about 2 or more.

2. The permanent magnet of claim 1, wherein said magnet is plastically deformed by at least one of hot upsetting and warm extrusion.

3. The permanent magnet of claim 1, wherein said microstructure comprised of fine crystal grains is obtained by rapidly quenching an alloy melt having said composition.

* * * * *